United States Patent [19]

Abdul-Malek et al.

[11] 4,149,980

[45] Apr. 17, 1979

[54] ASHLESS LUBRICANT ADDITIVES

[75] Inventors: A. Abdul-Malek, Warrenville; C. G. Brannen, West Chicago; W. C. Edmisten, Olympia Fields, all of Ill.

[73] Assignee: Standard Oil Company (Indiana), Chicago, Ill.

[21] Appl. No.: 810,292

[22] Filed: Jun. 27, 1977

[51] Int. Cl.[2] ..... C10M 1/40; C10M 3/34; C07C 123/00; C07C 128/00

[52] U.S. Cl. ..... 252/33; 252/391; 260/501.14

[58] Field of Search ..... 252/33, 33.2, 391; 260/501.14

[56] References Cited

U.S. PATENT DOCUMENTS

| | | | |
|---|---|---|---|
| 2,660,562 | 11/1953 | Axe et al. | 252/33 |
| 2,702,819 | 2/1955 | Axe et al. | 252/33 |
| 2,823,182 | 2/1958 | McLeod et al. | 252/33 |

*Primary Examiner*—Irving Vaughn
*Attorney, Agent, or Firm*—Mark DiPietro; Arthur G. Gilkes; William T. McClain

[57] ABSTRACT

Ashless lubricant additive compositions which contain a small but effective amount of overbased aminoguanidine sulfonate, sufficient to impart acid neutralization, antitrust, anticorrosive, dispersant, and detergent properties, are formed by reacting greater than about one mole of aminoguanidine with one mole of a hydrocarbon sulfonic acid.

18 Claims, No Drawings

ASHLESS LUBRICANT ADDITIVES

BACKGROUND

1. Field of the Invention

This invention relates to lubricating oil compositions and to lubricant additives. More particularly, overbased aminoguanidine sulfonate can be used as an additive to impart beneficial properties such as acid neutralization to lubricants.

2. Description of Prior Art

During the combustion of hydrocarbon fuels, acidic byproducts, and sludge are formed. These acidic materials and sludge are carried down into the lubricant present in internal combustion engines. The acidic materials and sludge, if left untreated, would cause severe deterioration of the lubricating properties of the lubricant. Additives are commonly added to lubricant to add properties needed for lubrication of modern engines. Modern lubricants must be able to suspend sludge and neutralize acidic materials produced by combustion.

Materials disclosed in the prior art which impart acid neutralizing properties are commonly formed by overbasing a hydrocarbon sulfonic acid with metal bases such as magnesium oxide, barium oxide, and calcium oxide. As the lubricating oil which contains the metal sulfonates is consumed, the metal forms ashy deposits and residue. This ashy residue causes problems. The ash can poison catalytic converters, interfere with normal combustion of fuel, and reduce the effectiveness of other additives in the lubricating oil. It is difficult and time consuming to produce metal overbased additives.

U.S. Pat. No. 2,823,182 discloses a normally liquid oleaginous compound, preferably a hydrocarbon oil, and from about 0.5% to about 70%, and preferably from about 1% to about 20%, of a guanidine sulfonate. The guanidine sulfonate can be the guanidine or alkyl guanidine salt of hydrocarbon oil sulfonic acids obtained in the treatment of hydrocarbon oils with strong sulfuric acid or of alkanesulfonic acids or of arylsulfonic acids, alkyl aryl sulfonic acids, and mixtures thereof. The sulfonic acids can be preferentially oil-soluble sulfonic acids or preferentially water-soluble sulfonic acids. However, when the guanidine salts of preferentially water-soluble sulfonic acids, i.e., low molecular weight, are employed, they are used in combination with salts of preferentially oil-soluble sulfonic acids.

U.S. Pat. No. 2,660,562 discloses improved ashless lubricant compositions comprising mineral oils incorporated with a guanidine salt of an organic sulfonic acid selected from the group consisting of synthetic guanidine alkyl aryl sulfonates and guanidine petroleum sulfonates, and containing from 0.1 to 60 weight percent of the guanidine salt.

U.S. Pat. No. 2,702,819 discloses synthetic guanidine alkyl hydrocarbonaryl sulfonates containing a total number of at least 10 carbon atoms in the alkyl groups. Many guanidine sulfonates are very insoluble compounds, unsuitable as lubricant additives.

Thus it is an object of the invention to produce an ashless additive composition. Another object of the invention is to produce an overbased additive which contains no metal salts. Still another object of the invention is to solubilize in lubricants large amounts of ashless basic materials. Another object of the invention is to produce an additive which does not poison catalytic converters, deposit metal ash in combustion chambers, but has acid neutralization, antirust, anticorrosive, dispersant, and detergent properties in lubricants.

SUMMARY OF THE INVENTION

Compositions of the invention are the ashless lubricant additive which is the reaction product of more than about 1 to about 10 mols of an aminoguanidine salt and about 1 mol of a hydrocarbon sulfonic acid formed at a temperature from about 70° F. to about 400° F. The aminoguanadine sulfonate is produced from an aminoguanidine salt which is the salt of an acid which is volatile at the reaction temperature. The aminoguanidine sulfonate made from the acetate, carbonate, bicarbonate, and hydrochloride salts of aminoguanidine. The aminoguanidine sulfonate can be made from alkenyl, alkyl, alkyl aryl, and petroleum sulfonic acids. The sulfonic acid can be polypropyl benzene or polybutyl benzene sulfonic acid where equivalent weight is from 300 to about 1200. The aminoguanidine sulfonate can also be made from polypropyl benzene sulfonate of an equivalent weight of 680 or 800. The composition of matter formed by an effective amount of the aminoguanidine sulfonate in a hydrocarbon lubricant is formed by the aminoguanidine sulfonate being about 0.1 percent to about 15 percent of the lubricant by weight.

The process for preparing aminoguanidine sulfonate is performed by dissolving an aminoguanidine salt in water, contacting the mixture with a hydrocarbon sulfonic acid, heating the mixture to solubilize the aminoguanidine and to remove the water at a temperature of from about 200° F. to about 320° F. in an inert carrier for a time from about 1 hour to about 4 hours under a blanket of nitrogen, and cooling the mixture to recover the additive. A process for preparing aminoguanidine sulfonate comprises dissolving from about 1 mol to about 8 mols of aminoguanidine bicarbonate in water, contacting the aminoguanidine bicarbonate with an equivalent weight of a solvent extracted 5W lubricating oil, contacting this mixture with polypropyl benzene sulfonate equivalent weight about 680 or 800, heating the mixture at a temperature of about 210° F. for about 1 hour, raising the temperature to about 310° F. for about 3 hours while blanketed under nitrogen gas, cooling the mixture, and recovering the product.

DETAILED DESCRIPTION

The aminoguanidine sulfonate can be produced by reacting a solution of aminoguanidine with a hydrocarbon sulfonic acid.

Aminoguanidine is a highly alkaline base. This alkalinity gives the aminoguanidine sulfonate the property of acid neutralization in oil. While aminoguanidine is insoluble in oil, reacting aminoguanidine and a hydrocarbon sulfonic acid creates an additive which will carry the alkaline aminoguanidine in oil solution.

Aminoguanidine is a nitrogen-containing organic compound of the formula $$NH_2-NH-\overset{\overset{\displaystyle NH}{\|}}{C}-NH_2.$$

Aminoguanidine can be prepared by the zinc reduction of nitroguanidine, *Org. Synthesis,* Coll. vol. 3, 399 (1941), by the reaction of cyanamide at 20° to 50° C. with hydrazine and carbon dioxide, German Patent No. 689,191, and other syntheses are disclosed in an article by Lieber and Smith, *Chem. Revs.*, 25, 213 (1939). Aminoguanidine can be prepared in the free state, or in the form of a salt of an acid free aminoguanidine in a relatively unstable compound. A salt of aminoguanidine is commonly more stable, and more generally easily reacted and solubilized. In most applications the salt is the equivalent of the free aminoguanidine.

Hydrocarbon sulfonic acids are polyalkenyl sulfonic acids, alkyl aryl sulfonic acids, or petroleum sulfonic acids. Polyalkenyl sulfonic acids are produced by sulfonating a polyalkene. The polyalkene is commonly formed by polymerization of ethylene, propene, and butene in common polymerization reactions. The molecular weight of the polymers are from about 300 to about 1200. Alkyl aryl sulfonic acids are produced by alkylating benzene, or other aromatic nuclei with a polyalkene of a molecular weight of about 300 to about 1200 and sulfonating the polyalkyl benzene in the manner found below.

Petroleum sulfonates having exceptional lubricating oil additive properties are obtained from an aromatic sulfonation base stock selected from the more viscous bright stock fractions of petroleum and having a viscosity of 120 to 700 SUS at 210° F. Deasphalted and solvent-refined petroleum fractions having a viscosity between about 150 and 600 SUS at 210° F. are preferred. A specifically preferred sulfonation stock is a propane-fractioned, solvent extracted and de-waxed Mid-Continent oil of about 200 to 230 SUS at 210° F. having a viscosity index of about 85 to 95 or even higher.

Oleum can be the sulfonating agent. The oleum can vary from 10 percent excess $SO_3$ to 40 percent excess $SO_3$; however, commercial oleum, which represents about 20 percent excess $SO_3$ can be used. Sulfonation temperatures are ordinarily controlled within the range of about 50°–200° F. with a preferred operating range between 80°–150° F. Lower temperatures can be used without seriously slowing down reaction rates, but no particular advantage results. At temperatures above about 200° F., excessive oxidation with liberation of $SO_2$ takes place. The acid/hydrocarbon ratio employed can range from about 0.2/1 to about 0.6/1 depending upon the sulfonation temperature employed.

The aminoguanidine sulfonate is produced according to the following general reaction:

$$y[NH_2HN\overset{\overset{\displaystyle NH}{\|}}{C}NH_2 \cdot HX] + HSO_3R \xrightarrow{[heat]} [NH_2NH\overset{\overset{\displaystyle NH}{\|}}{C}NH_2]_yHSO_3R + HX.$$

y is a number from 1 to 10, R represents an alkyl, alkenyl, alkylaryl, or petroleum group.

In this reaction, as the sulfonic acid is consumed an acid is produced. This acid must be volatile at the reaction temperature. Commonly this acid is carbonic acid, acetic acid, or hydrochloric acid. The reaction is performed by dissolving aminoguanidine salt in water and heating this mixture with the hydrocarbon sulfonic acid. The aminoguanidine is reacted with the sulfonic acid in a ratio of about 1–8:1. The mixture is heated until the temperature reaches about 225° F. to about 350° F. for a time from one to three hours. During this heating process the water is driven away and the aminoguanidine is solubilized in the sulfonic acid. The mixture may be blown with nitrogen to speed removal of water. Alternatively, a lubricating oil base can be added to the reaction mixture as a carrier for the additive.

The additive commonly is used in lubricating oils in amounts of about 0.1% to about 15% by volume of oil. The preferred compositions are about 3.5% to about 4.5%, about 4.7% to about 5.2%, about 6.5% to about 7.5% by volume of oil. The additives produced have total base numbers up to 190. The total base number is a measure of the excess base in the additive over the stoichiometric amount needed to neutralize the sulfonic acid.

EXAMPLE 1

13.9 gm aminoguanidine bicarbonate is dissolved in 20 ml water and placed in a round bottom flask under a blanket of nitrogen. 59 gm of ammonium polybutyl sulfonic acid and 65 grams of SX-5 oil is added to the aminoguanidine bicarbonate. The viscosity of the polymer at 100° F. is 130 SUS. The equivalent molecular weight is about 450. This mixture is heated to 212° F. for 1 hour to remove water. The water vapor is swept out of the flask with nitrogen. The mixture is then heated for 2 hours at 300°–320° F. The mixture is cooled and ready for use.

EXAMPLE 2

36.8 gm aminoguanidine bicarbonate is dissolved in 20 ml of water and placed in a round bottom flask under a blanket of nitrogen. 200 gm of Bryton sulfonic acid and 113 gm of SX-5 oil is added to the aminoguanidine bicarbonate. Bryton sulfonic acid is an alkyl aryl sulfonic acid purchased from Bryton Chemical Company which is a polypropyl benzene sulfonic acid the equivalent molecular weight of which is about 460. The mixture is heated to 340° F. while blanketed with nitrogen, and is reacted for 2 hours. When the mixture is cooled, it is ready for use.

EXAMPLE 3

16.3 gm of aminoguanidine bicarbonate is dissolved in 20 ml of water and placed in a round bottom flask under a blanket of nitrogen. 156.5 gm of benzene sulfonic acid and 59 gm of SX-5 oil is added to the aminoguanidine bicarbonate. $C_{20}$ benzene sulfonic acid is a polypropyl benzene sulfonic acid, the equivalent weight of which is about 680. The mixture is heated to a temperature of 340° F. for two hours while blanketed with nitrogen. The mixture is then cooled and ready for use.

EXAMPLE 4

17.0 gm of aminoguanidine bicarbonate is dissolved in 20 ml of water and placed in a round bottom flask under a stream of nitrogen. 175 gm of $C_{60}$ benzene sulfonic acid is added to the aminoguanidine. 72 gm of SX-5 oil is added to the mixture. $C_{60}$ benzene sulfonic acid is a polypropyl benzene sulfonic acid the equivalent molecular weight of which is 800. The mixture is heated to a temperature of 340° F. for two hours while blanketed with nitrogen. The mixture is then cooled and ready for use.

EXAMPLE 5

40.0 gm of aminoguanidine bicarbonate is dissolved in water and placed in a round bottom flask under a stream of nitrogen. 175 gm of $C_{60}$ benzene sulfonic acid is added to the aminoguanidine bicarbonate. 72 gm of SX-5 oil is added to the mixture. The mixture is heated to a temperature of 340° F. for two hours while blanketed with nitrogen. The mixture is then cooled and is ready for use.

EXAMPLE 6

80 gm of aminoguanidine bicarbonate is dissolved in 20 ml of water and placed in a round bottom flask under a stream of nitrogen. 50 gm of Bryton sulfonic acid is added to the aminoguanidine bicarbonate. 67 gm of SX-5 oil is added to the mixture. The mixture is then heated to 340° F. for two hours while blanketed with nitrogen. The mixture is then cooled and is ready for use.

EXAMPLE 7

80 gm of aminoguanidine bicarbonate is dissolved in water and placed in a round bottom flask under a stream of nitrogen. 78.3 gm of $C_{20}$ benzene sulfonic acid is added to the aminoguanidine bicarbonate. 69 gm of SX-5 oil is added to the mixture. The mixture is then heated to 340° F. for two hours while blanketed with nitrogen. The mixture is then cooled and is ready for use.

EXAMPLE 8

80 gm of aminoguanidine bicarbonate is dissolved in 20 ml water and placed in a round bottom flask under a stream of nitrogen. 88 gm of $C_{60}$ benzene sulfonic acid is added to the aminoguanidine bicarbonate. 75 gm of SX-5 oil is added to the mixture. The mixture is heated to 340° F. for two hours while blanketed with nitrogen. The mixture is then cooled and is ready for use.

EXAMPLE 9

100 gm of aminoguanidine bicarbonate is dissolved in 100 ml of water and placed in a round bottom flask under a stream of nitrogen. 30 gm of L-13 ammonium sulfonate is added to the aminoguanidine bicarbonate solution. 63 gm of SX-5 oil is added to the mixture. The mixture is heated to 340° F. for two hours under a stream of nitrogen. The mixture is then cooled and ready for use.

EXAMPLE 10

50 gm of aminoguanidine bicarbonate is dissolved in 100 ml of water and placed in a round bottom flask under a stream of nitrogen. 200 gm of $C_{60}$ benzene sulfonic acid is added to the aminoguanidine solution. 50 gm of SX-5 oil is added to the mixture. The mixture is reacted at room temperature for one hour. The mixture is then heated to a temperature of 300° F. for two hours under a stream of nitrogen. The mixture is cooled and is ready for use.

EXAMPLE 11

70 gm of aminoguanidine bicarbonate is dissolved in 100 ml of water and placed in a round bottom flask under a stream of nitrogen. 200 gm of $C_{60}$ benzene sulfonic acid is added to the aminoguanidine solution. 50 gm of SX-5 oil is added to the mixture. The mixture is reacted at room temperature for one hour. The mixture is then heated to 300° F. for two hours under the stream of nitrogen. The mixture is cooled and is ready for use.

ADDITIVE PACKAGES WHICH ARE USED IN TESTING PROCEDURES WHICH EXEMPLIFY THE LUBRICANT PROPERTIES OF THE ADDITIVE

| Product in Example | TBN | Valve Lifter Tests | | | | | Hot Tube Tests | | | | | | | Amihot Tests | | | |
|---|---|---|---|---|---|---|---|---|---|---|---|---|---|---|---|---|---|
| | | A | B | C | D | E | F | G | H | I | J | K | L | M | N | O | P |
| 1 | 144 | — | 4.0 | — | — | — | — | — | — | — | — | — | — | — | — | — | — |
| 2 | 103 | — | — | 4.0 | — | — | — | — | — | — | — | — | — | — | — | — | — |
| 3 | 88 | — | — | — | 4.0 | — | — | — | — | — | — | — | — | — | — | — | — |
| 4 | 62 | — | — | — | — | 4.0 | — | — | — | — | — | — | — | — | — | — | — |
| 5 | 33 | — | — | — | — | — | — | 7.0* | — | — | — | — | — | — | — | — | — |
| 10 | 50 | — | — | — | — | — | — | — | 7.0* | — | — | — | — | — | — | — | — |
| 9 | 0 | — | — | — | — | — | — | — | — | — | 7.0 | — | — | — | — | — | — |
| 6 | 0 | — | — | — | — | — | — | — | — | — | — | 7.0 | — | — | — | — | — |
| 7 | 0 | — | — | — | — | — | — | — | — | — | — | — | — | 4.0 | 4.0 | 4.0 | 4.0 |
| (Current additives) | | | | | | | | | | | | | | | | | |
| Bis(octyldithio) thiazole | | 0.3 | 0.3 | 0.3 | 0.3 | 0.3 | — | — | — | — | — | — | 0.3 | 0.3 | 0.3 | 0.3 | 0.3 |
| Bis(p-dodecylphenol)sulfide | | 3.0 | 3.0 | 3.0 | 3.0 | 3.0 | — | — | — | — | — | — | 3.0 | 3.0 | 3.0 | 3.0 | 3.0 |
| Calcium polyalkybenzene sulfonate | | — | — | — | — | — | — | — | — | — | — | — | — | — | — | — | — |
| Mannich condensate I** | | — | — | — | — | — | 7.0 | — | — | 7.0* | — | — | — | — | — | — | — |
| Mannich condensate II*** | | 7.0 | 7.0 | 7.0 | 7.0 | 7.0 | — | — | — | — | — | — | 7.0 | 7.0 | 7.0 | 7.0 | 7.0 |

All made in SAE 30W oil except where *, made in SAE 10W-30 oil.
**Mannich condensate I is ashless dispersant made from polybutyl phenol treated with boric acid condensed with tetraethylene pentamine, oleic acid, formalin or paraformaldehyde.
***Mannich condensate II is an ashless high-nitrogen Mannich dispersant made by blending a super boron component with the reaction product of polybutyl phenol,tetraethylene pentamine, oleic acid and formaldehyde.

The following test procedures disclose the varied properties of the additive in lubricating oils. The aminoguanidine sulfonate displays antirust, detergent, anticorrosion, dispersion, and acid neutralization properties.

The valve lifter rust test used in the developmental work for this additive is used to test lubricant anti-rust properties under test conditions that simulate stop and go, cold driving.

A valve lifter is placed in a volume of test oil containing 0.5% water by volume oil and 1 ml of gaseous hydrochloric acid per gram of oil. The container is kept at room temperature and at 50% relative humidity for 1 to 4 weeks. Standard IIB rust ratings are used. That is, 10 is a perfect score and 0 is a total failure.

| Additive Package | Test Results Valve Lifter Rust Test | | | | |
|---|---|---|---|---|---|
| | A | B | C | D | E |
| at 72 hr. Plunger | 4.0 | 8.5 | 8.0 | 9.0 | 9.0 |

-continued

| Additive Package | Test Results Valve Lifter Rust Test A | B | C | D | E |
|---|---|---|---|---|---|
| Ball at 144 hr. | 5.0 | 8.0 | 9.0 | 9.5 | 9.5 |
| Plunger | 3.0 | 7.5 | 8.0 | 9.0 | 8.5 |
| Ball at 240 hr. | 3.0 | 7.5 | 8.0 | 8.5 | 7.5 |
| Plunger | 2.0 | 7.0 | 7.5 | 8.5 | 8.0 |
| Ball | 2.0 | 7.0 | 7.5 | 8.5 | 7.0 |

The hot tube varnish test used in the development of the additive determines the detergency of the oil package.

In the test, a test oil and heated air or gases are passed upward through a 2 mm capillary tube which is heated in an aluminum block. An oil with good detergent properties will leave little lacquer deposit on the tube. The tubes are rated zero to 10. Zero being heavy black opaque deposit and 10 being clean, a perfect score.

| Additive Package | Hot Tube Varnish Test Results F | G | H | I | J | K |
|---|---|---|---|---|---|---|
| Air at 490° F. | 6.5 | 6.0 | 5.5 | 2.0 | 4.5 | 4.5 |
| $NO_x$ at 395° F. | 5.0 | 7.5 | 7.5 | 2.5 | 6.5 | 7.5 |

The Amihot corrosion test used in the development of the additive is a test which determines the tendency of oil to corrode bearing surfaces with oxidation products.

100 gm of test oil are oxidized at 325° F. in an open tube. The sample is blown with 30 ml/minute of air. Oxidation catalysts are added to the oil at a concentration of 1% of equimolar mixture of 1,2-dibromoethane and 1,2-dichloroethane. A weighed lead coupon is hung in the oil. The weight lost during the test is measured. Generally, weight loss of 2 mg or less is a passing score; 2 mg to 5 mg loss is a borderline score; and 5 mg or greater weight loss is a failing score.

| Additive Package | Amihot Corrosion L | M | N | O | P |
|---|---|---|---|---|---|
| Pb wt Loss (mg) | 142 | 13 | 22 | 18 | 34 |

In this test the corrosions are high, and are shown here in a comparison with other ashless lubricant additives. The disclosed novel additive shows better corrosion properties than the standard additive.

The spot dispersing test used in developing the additive in a test which determines the property of the oil to disperse sludge and varnish formed in engine oil. A quantity of additive is added to a heavily sludged oil. The mixture is heated overnight in a closed container at 300° F. 3 to 10 drops of this mixture are placed on a standard white blotter paper. An oil with excellent dispersancy will carry the sludge along with the oil as the oil spreads out through the blotter paper. The diameter of the oil circle is measured and the diameter of the sludge circle is measured.

Rating = Diameter of sludge/diameter of oil X 100.

A rating with no additive generally is about 40. An excellent additive will give a rating of about 80 or better.

| Example | | | | | | | | |
|---|---|---|---|---|---|---|---|---|
| 5 | — | — | 5 | — | — | — | 7 | — |
| 11 | — | — | — | 5 | — | — | — | 7 |
| Mannich I | 5 | — | — | — | 7 | — | — | — |
| Mannich II | — | 5 | — | — | — | 7 | — | — |
| Mild Sludge | 95 | 95 | 95 | 95 | — | — | — | — |
| Severe Sludge | — | — | — | — | 93 | 93 | 93 | 93 |
| Dispersancy rating | 88 | 100 | 87 | 91 | 73 | 91 | 98 | 97 |

The lubricating oils in which the compositions of this invention are useful as additives and which comprise a major proportion of the lubricating oil compositions may be of synthetic, animal, vegetable, or mineral origin. Ordinarily mineral lubricating oils are preferred by reason of their availability, general excellence, and low cost. For certain applications, oils belonging to one of the other three groups may be preferred. For instance, synthetic polyester oils such as didodecyl adipate and di-2-ethylhexyl sebacate are often preferred as jet engine lubricants. Normally the lubricating oils preferred will be fluid oils, ranging in viscosity from about 40 Saybolt Universal seconds at 100° F. to about 200 Saybolt Universal seconds at 210° F. This invention contemplates also the presence of other additives in lubricating compositions. Such additives include, for example, viscosity index improving agents, pour point depressing agents, anti-foam agents, extreme pressure agents, rust-inhibiting agents, and oxidation and corrosion inhibiting agents.

We claim:

1. An ashless lubricant additive composition comprising an overbased aminoguanidine hydrocarbon sulfonate containing greater than about one mole to about eight moles aminoguanidine per mole of hydrocarbon sulfonic acid.

2. The composition of claim 1 wherein the hydrocarbon sulfonic acid is chosen from a group consisting of alkenyl sulfonic acid, alkylarylsulfonic acid, and mahogany petroleum sulfonic acid.

3. The composition of claim 2 wherein the hydrocarbon sulfonic acid is a polypropyl benzene sulfonate or a polybutyl benzene sulfonate, the equivalent weight of which ranges from about 300 to about 1200.

4. The composition of claim 2 wherein the hydrocarbon sulfonic acid is polypropyl or polybutyl benzene sulfonic acid, the equivalent weight of which ranges from about 500 to about 700.

5. The composition of claim 2 wherein the hydrocarbon sulfonic acid is polypropyl or polybutyl benzene sulfonic acid, the equivalent weight of which ranges from about 700 to about 900.

6. A lubricant comprising a major portion of a lubricant oil and an effective amount of an overbased aminoguanidine hydrocarbon sulfonate containing greater than about one mole to about eight moles of aminoguanidine per mole of hydrocarbon sulfonic acid.

7. The composition of claim 6 wherein aminoguanidine sulfonate is from about 0.1% to about 15% of the lubricant by weight.

8. The composition of claim 6 wherein the hydrocarbon sulfonic acid is chosen from a group consisting of alkenyl sulfonic acid, alkylarylsulfonic acid, and mahogany petroleum sulfonic acid, whose molecular weight is from about 300 to about 1200.

9. The composition of claim 8 wherein the sulfonic acid is polypropyl benzene sulfonic acid, the equivalent weight of which is about 680.

10. The composition of claim 8 wherein the sulfonic acid is polypropyl benzene sulfonic acid, the equivalent weight of which is about 800.

11. A process for preparing overbased aminoguanidine sulfonate comprising forming an aqueous mixture of from about 1 mole equivalent to about 8 moles equivalents of an aminoguanidine or an aminoguanidine salt, contacting this aqueous mixture with about one mole of a hydrocarbon sulfonic acid, heating the mixture at a temperature of from about 200° F. to about 320° F. in an inert carrier for a time of from about 1 hour to about four hours under a blanket of nitrogen, and cooling the mixture to recover the overbased aminoguanidine sulfonate.

12. The process of claim 11 wherein the aminoguanidine salt is a salt of an acid which is volatile at the reaction temperature.

13. The process of claim 11 wherein the aminoguanidine salt is chosen from a group consisting of aminoguanidine bicarbonate, aminoguanidine acetate, and aminoguanidine hydrochloride.

14. The process in claim 11 wherein the hydrocarbon sulfonic acid is a hydrocarbon sulfonic acid selected from the group consisting of polypropyl benzene sulfonic acid equivalent weight of about 460, polypropyl benzene sulfonic acid equivalent weight of about 680, polypropyl benzene sulfonic acid equivalent weight of about 800 and polybutyl benzene sulfonic acid equivalent weight of about 450.

15. The process of claim 11 wherein the inert carrier is a solvent extracted lubricating oil.

16. A process for preparing aminoguanidine sulfonate comprising dissolving from about 1 mole to about 8 moles of aminoguanidine bicarbonate in water, contacting the aminoguanidine bicarbonate with an equivalent weight of a solvent extracted 5W lubricating oil, contacting the mixture with polypropyl benzene sulfonic acid equivalent weight about 680 or about 800, heating the mixture at a temperature about 210° F. for about 1 hour, raising the temperature to about 310° F. for about 3 hours while blanketed under nitrogen gas.

17. The additive of claim 1 wherein the composition has a Total Base Number at least about 33.

18. The lubricant of claim 6 wherein the overbased aminoguanidine hydrocarbon sulfonate has a Total Base Number at least about 33.

* * * * *